US005139258A

United States Patent [19]

McPoyle

[11] Patent Number: 5,139,258

[45] Date of Patent: Aug. 18, 1992

[54] PADDLE BALL RACQUET

[75] Inventor: Stephen F. McPoyle, Lake Worth, Fla.

[73] Assignee: Party Pong Inc., West Palm Beach, Fla.

[21] Appl. No.: 830,370

[22] Filed: Jan. 31, 1992

[51] Int. Cl.[5] ..... A63B 59/04

[52] U.S. Cl. ..... 273/76; 273/73 J; 273/30

[58] Field of Search ..... 273/73 R, 73 G, 73 J, 273/76, 29 R, 29 A, 30

[56] References Cited

U.S. PATENT DOCUMENTS

| | | | |
|---|---|---|---|
| 1,986,154 | 1/1935 | Marks | 273/76 |
| 4,052,060 | 10/1977 | Balkcom | 273/73 G X |
| 4,353,550 | 10/1982 | Krosnick | 273/76 X |
| 4,367,871 | 1/1983 | Schiefer | 273/73 J X |
| 4,746,119 | 5/1988 | Jeanrot | 273/73 J X |
| 4,915,382 | 4/1990 | Madsen | 273/73 J X |

FOREIGN PATENT DOCUMENTS

| | | | |
|---|---|---|---|
| 0358586 | 9/1922 | Fed. Rep. of Germany | 273/73 G |
| 2590802 | 6/1987 | France | 273/73 J |
| 0431394 | 7/1935 | United Kingdom | 273/73 G |

*Primary Examiner*—William H. Grieb
*Assistant Examiner*—William E. Stoll
*Attorney, Agent, or Firm*—John H. Faro

[57] ABSTRACT

A paddle ball racquet for a slow paced table tennis game is herein disclosed. The racquet is modified to eliminate the advantage of the power player by imparting flex or articulation between the racquet handle and the paddle surface. The design parameters of the racquet prevents accurate return of the game ball if the racquet speed exceeds certain empirically determined limits. Accordingly, the racquet handicaps the power hitter and thereby emphasizes accuracy in shot placement. The racquet of this invention can be used in conventional table tennis; or, in conjunction with a unique table tennis layout designed for accurate shot placement.

4 Claims, 4 Drawing Sheets

PADDLE BALL RACQUET

BACKGROUND OF THE INVENTION

1. Field of the Invention

This invention is directed to an apparatus and a method for use thereof. More specifically, this invention concerns a unique paddle ball racquet and a game utilizing its unique properties.

2. Description of the Prior Art

The evolution and modification of tennis, badminton and ping pong racquets over the years has been typically motivated by the innovators perceived deficiencies in existing designs, or, alternatively, to impart additional uses thereof (i.e. training aids). The following patents are representative of the prior art: U.S. Pat. Nos. 4,353,550; 4,367,871; 3,679,205; 1,617,243; and 702,697.

U.S. Pat. No. 4,353,550 describes a paddle ball racquet with adjustment for flexing of the racquet paddle relative to the racquet handle. In brief, the adjustment is equated in function to variable tensioning of the racquet strings. The tighter the strings, the livelier or more powerful the serve or return volley. Conversely, where the adjustment increases the flex of the paddle relative to the handle, the inventor reports that the serve or volley is slowed down. There is apparently no effect on the accuracy of the shot placement by such adjustment.

U.S. Pat. No. 4,367,871 describes a sports racquet modified for training of proper tennis stroke, including serving and volleying techniques. The racquet is modified by providing articulation or flexing between handle and racquet head. The means for accomplishing such relative movement are internal to the handle and simple consists of a spring or equivalent member (FIG. 4). The degree of flex is limited by the inventor to prevent "uncontrolled relative pivotal movement" of the head relative to the handle (Column 5, lines 52–55). Accordingly, the degree of flex is controlled to provide for effective instruction of the novice player in the proper stroking techniques without sacrifice in accuracy on shot placement U.S. Pat. No. 3,679,205 describes a novel tennis racquet design for improving or developing a tennis swing. The tennis racquet is provided with a hinge intermediate the handle or racquet head to permit hinged/articulating movement of each component relative to the other. The objective of the inventor is similar to that of the inventor '871 patent discussed above. In addition to allowing for articulation/flexing of the racquet head relative to the handle, the inventor has provided for restriction of relative movement by locking the hinge (column 3, lines 33–42).

U.S. Pat. No. 1,617,243 describes a badminton-like game in which a shuttlecock is put and kept in play by a racquet of unique construction. The racquet consists of a conventional handle and a racquet head covered with a sheet of rubber (i.e. in lieu of conventional stringing). The rubber like striking surface is stretched over the racquet head and conforms to the shape of the frame. The rubber membrane is presumably more resilient (less taut) than conventional stringing and, thus, the impact of the striking surface of the racquet on the shuttlecock is reduced, as is the speed of the serve and/or volley.

U.S. Pat. No. 702,697 describes a house tennis racquet similar in construction to the badminton racquet of the '243 patent described above.

As is evident from the foregoing discussion, the various modifications in racquet design have been made to lessen the impact of the striking surface of the racquet upon the ball or shuttlecock, and thereby provide enhanced degree of control. Such control is apparently perceived as necessary where the racquet is used in training or in an environment in which control is favored over speed. In each instance, there is apparently insignificant flex in the racquet to otherwise adversely affect the accuracy of placement of the ball/shuttlecock.

To the extent that sufficient rigidity in racquet design is preserved, the more experienced player and/or power hitter retains decided advantage over the player who relies upon finesse rather than speed to outpoint his opponent. Accordingly, there is a continuing need to provide a racquet design to offset the inherent advantage of the power hitter and, thereby, increase the competitiveness of the game.

OBJECTS OF THE INVENTION

It is the object of this invention to remedy the above as well as related deficiencies in the prior art.

More specifically, it is the principle object of this invention to provide a table tennis racquet which constrains the power hitter from overwhelming a less experienced player.

It is another object of this invention to provide a table tennis racquet which handicaps a power hitter by precluding accurate shot placement upon rapid acceleration of paddle.

SUMMARY OF THE INVENTION

The above and related objects are achieved by providing a paddle ball racquet having a handle connected to a paddle frame by a hinge/articulating joint, whereby the handle and paddle frame are maintained in a neutral (at rest) position relative to one another by restraining means, either internal to the hinge/articulating joint, or alternatively, external to the joint, in the form of a restraining means which limits the degree of articulation and returns paddle frame and the handle to a neutral position. The paddle frame consists of a rim which defines a hollow space or void and a skin or membrane which is stretched over the frame to provide a taut surface for impact of the game piece (ball or shuttlecock). In practice, the selection of membrane material, and its properties, is consciously made to provide the requisite degree of tautness to the paddle frame surface.

The combined effect of the restraint upon articulation of the paddle frame and tautness of the membrane (which covers the paddle frame) determines the extent of control the player will retain in both serving and volleying by limiting the speed at which the paddle can be manipulated and still retain its configuration in a neutral position. To the extent that paddle speed causes articulation of the paddle frame relative to the handle, accurate shot placement is effectively diminished (the degree of accuracy being related to the degree of articulation of the paddle frame relative to the handle from a neutral position and the speed at which the game piece impacts the membrane surface of the paddle frame).

To the extent the original characteristics of a conventional table tennis paddle are attenuated by the combined effect of the above modifications, the racquet handicaps the player who attempts to slam the game piece thereby placing emphasis upon accuracy of shot placement and finesse.

DESCRIPTION OF THE INVENTION INCLUDING PREFERRED EMBODIMENTS

The drawings which accompany this application are illustrative of the preferred embodiments thereof. Where a common element appears in one or more of the accompanying drawings it is assigned the same referenced numeral in order to aid and understanding and ease of description.

Figure 1:
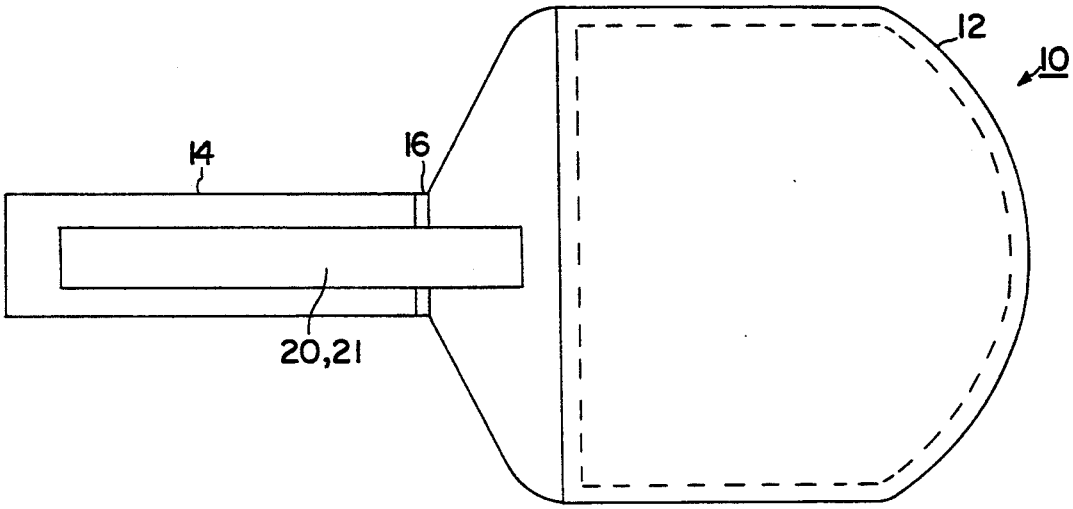
FIG. 1 is a perspective view of the improved table tennis racquet of this invention.

FIG. 1 is a perspective view of the improved table tennis racquet (10) of this invention. In brief, the racquet consists of three functional components, which include, a hollow paddle frame (12), a handle (14) and an articulating joint (16) which connects the handle to the paddle frame. The paddle consists of a hinge-like arrangement (18) which allows the paddle frame to flex relative to the handle upon accelerated movement of the racquet as in the stroking of a ping pong ball. The paddle frame is maintained in a relatively stationary at rest position relative to the handle by restraining straps (20, 21) which are fixedly attached to both the handle (14) and to the base of the paddle frame (22). These tensioning straps are themselves flexible or elastomeric, thereby allowing for articulation of the paddle frame (12) relative to the handle. The resiliency of the straps returns the paddle frame to the at rest position after flexing thereof. The paddle frame itself consists of a hollow housing which is covered on its major surfaces by a resilient or elastomeric material (24). The resilient or elastomeric material is of sufficient thickness to provide an impact surface to a game ball thereby affect its return upon impact with such surface. The surface is, however, sufficiently resilient to absorb a portion of the impact and thereby reduce the velocity of the ball when struck by the paddle. The position of the paddle frame relative to the handle, in the at rest position, is such that in practice the amount of flex between the two major components is controlled and adjusted empirically to allow for controlled impact of the paddle frame upon the game ball. Where the paddle is unduly accelerated, the inertia of the paddle frame relative to the handle will cause the paddle frame to flex relative to the handle thereby precluding precise sharp placement, thus handicapping the power hitter. The overall configuration and dimension of the paddle frame relative to the handle is consistent with conventional table tennis although it is possible to vary such frame and handle in size to accommodate different types of game pieces including ping pong balls, shuttlecocks and the like.

Figure 2:
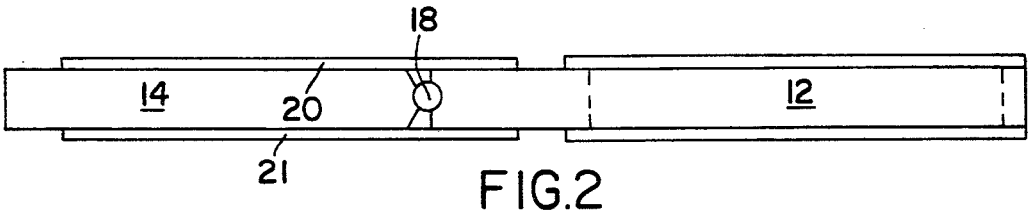
FIG. 2 is a cross-section, along the mid-line of the racquet of FIG. 1, from the top of the paddle frame to the base of the paddle handle.
Figure 3:
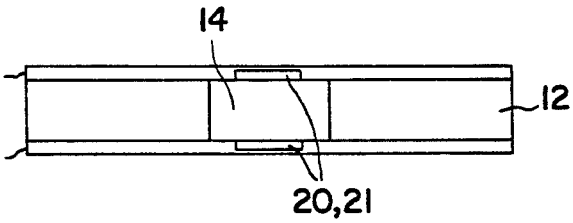
FIG. 3 is an end on view of the racquet of FIG. 1 from the handle end.
Figure 4:
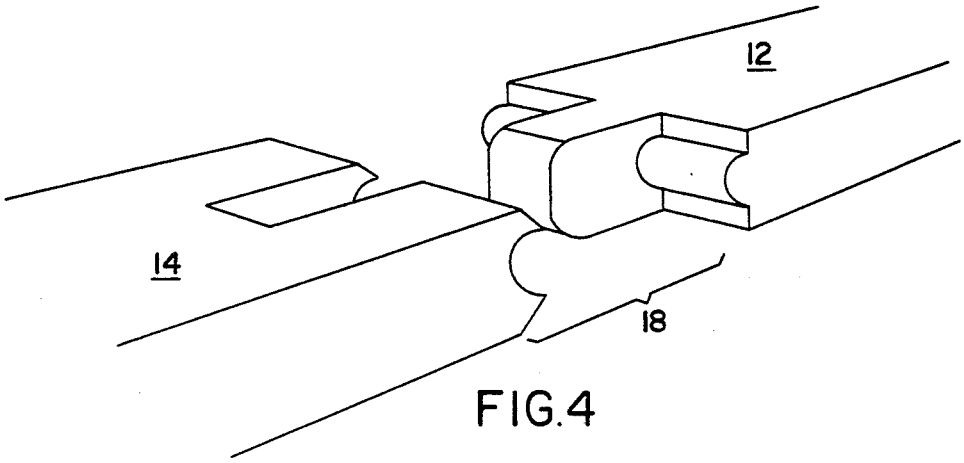
FIG. 4 is a an exploded view of a hinged joint which connects the paddle frame to the paddle handle of the racquet of FIG. 1.
Figure 5:
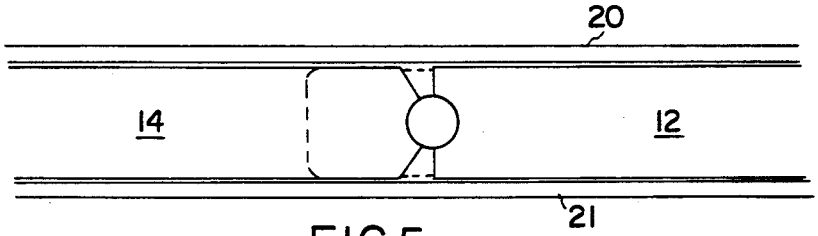
FIG. 5 shows the joint of FIG. 4 in the at-rest position.
Figure 6:
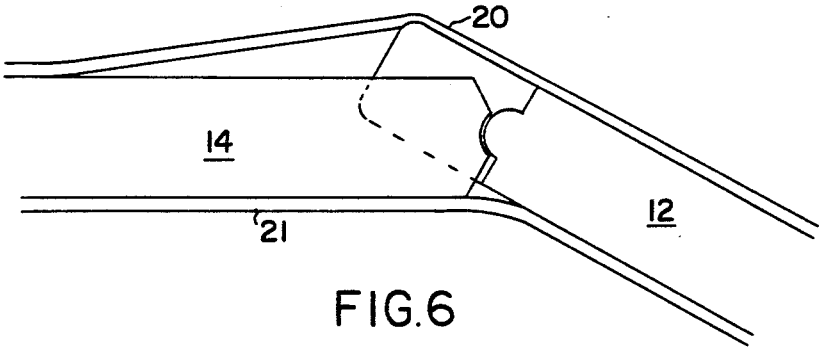
FIG. 6 shows the joint of FIG. 4 in the flexed/distended position.
Figure 7:
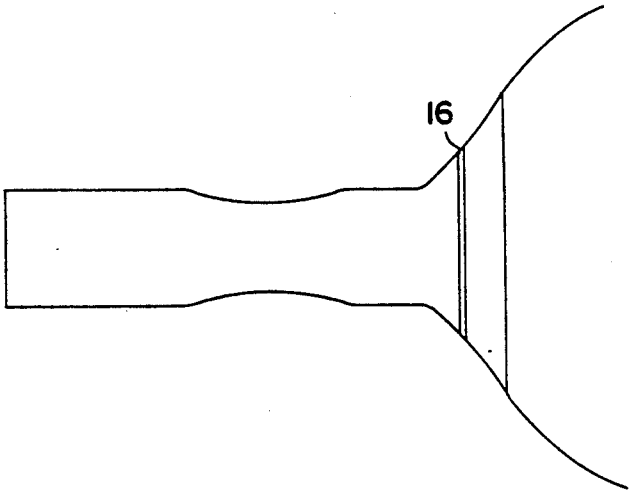
FIG. 7 illustrates an alternative embodiment of the racquet of this invention wherein the articulating joint is essentially totally internal to the handle.
Figure 8:
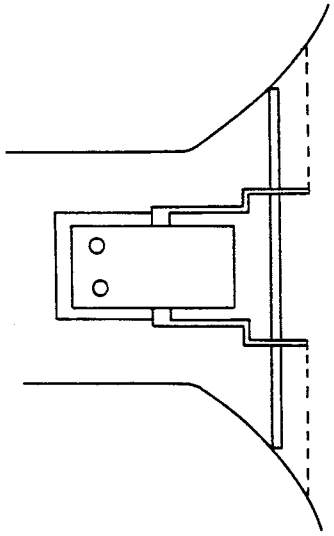
FIG. 8 is an exploded view of the articulating joint of FIG. 7.
Figure 9:
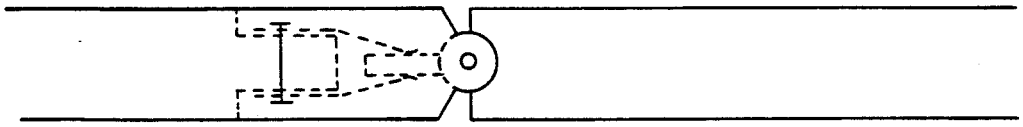
FIG. 9 is a cross-sectional view of the joint of the racquet paddle of FIG. 7.

FIG. 2 illustrates, in cross-section, along the mid line of the racquet a relative provision of each of the functional components thereof. FIG. 3 shows end view of the racquet when viewed from the bottom or the handle end of the racquet. FIG. 4 shows an exploded view of the hinged joint in FIG. 1. FIG. 5 shows the joint of FIG. 4 in the at rest position and FIG. 5 the joint of FIG. 3 in the flexed or distended position. FIGS. 7, 8 and 9 illustrate alternative embodiments of the joint of the racquet of FIG. 1. More specifically, in FIG. 7 the restraining straps are internal to the handle and consist, in lieu of elastomeric material steel spring like members (FIG. 8). FIG. 9 is a cross-section to the joint of FIG. 7 along the mid line of the racquet.

The various materials from which the racquet is constructed are well known in the yard and can and will vary depending upon the objectives of the practitioner. In general, the objective of the racquet will be to handicap the power hitter to place him on equal footing with the less experienced or player that relies on finesse as end shot placement. Accordingly, an effort by the power hitter to unduly accelerate the racquet will cause it the paddle frame to flex at the joint and thereby preclude precise placement of the game piece upon impact with the resilient cover of the paddle frame.

It is contemplated that the unique table tennis racquet of this invention can be used both in conventional table tennis and in one or more games designed to place an emphasis on accuracy of shot placement as opposed to definitely putting the shot away. More specifically, the game board contemplated for use in this invention can include one or more targets on the game field or, alternatively, one or more targets or goals which are placed mid-point between the two players (i.e. net line).

Figure 10:
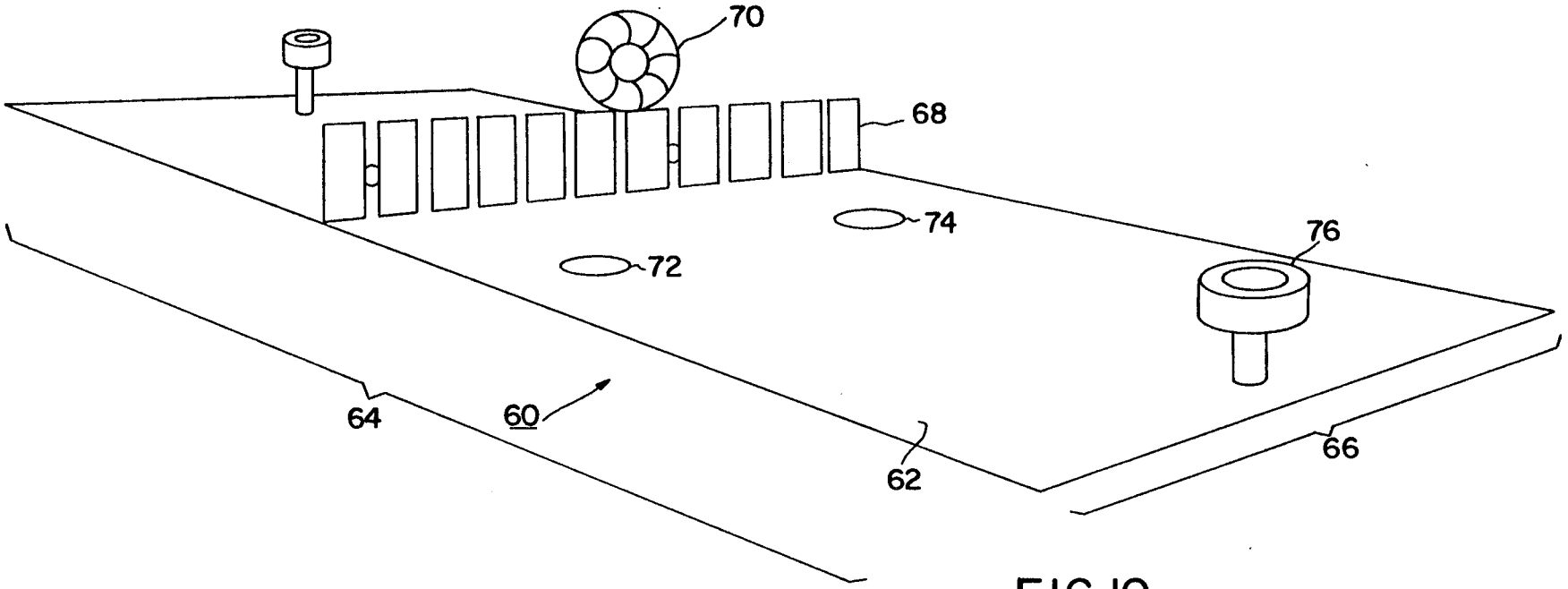
FIG. 10 depicts a illustrative playing field (i.e. table top) which can be utilized in conjunction with the paddle of this invention.

In the preferred embodiments of this invention the racquet in this invention can be used in conjunction with a game table (60) of the configuration of FIG. 10. In brief, the game table can include a surface (62) having a long dimension (64) and a relatively short dimension (66). The long dimension is divided preferably in half by a fence or net (68). In the preferred embodiment of this invention a target (70) can be located along the fence or net (68). Each side of the table will also include one or more goals (72, 74, 76) or targets either recessed in the surface of the table or positioned above the table top. In practice, the individuals playing the game would stand on opposite sides of the table top facing one another and strike the game piece, (i.e. ball) with the racquet. The serving and volleying would proceed in a manner analagus to table tennis. Points would be scored by precision placement of the game piece either through one or more of the targets located along the fence or in the targets or goals located on the opponents side of the fence. Scoring would be based upon the value assigned to the respective targets in the game and winner determined upon accumulation of sufficient points. The table top which forms the playing fields can be of a conventional table tennis size or of a reduced size. In any event, the space required to play the game is reduced because the play is confined more or less to the area defined by the table top since no points would, presumably, be scored if the ball is not maintained in play, unlike traditional table tennis where points are scored by putting the shot away (i.e. smashing it) or otherwise having the opposing player miss a return volley. The foregoing game is but illustrative of one of the embodiments of which the unique paddle design can be utilized. The advantages of the paddle make it uniquely adapted for this type of play in that it places a premium upon finesse and shot placement and thus minimizes the aggressiveness traditionally associated with power slamming table tennis.

The foregoing invention has been described in reference to one or more of the preferred embodiments thereof depicted in the accompanying drawings. The foregoing description as been provided is simply illustrative of the preferred embodiments of the concept and not intended to delineate its scope which is set forth in the claims which follow.

What is claimed is:

1. In a table tennis racquet having a handle, a paddle frame and means therebetween for permitting hinged articulating movement therebetween, the improvement comprising:

(a) a handle defining a hand grip having one end thereof modified for articulating engagement to a complimentary modification on a paddle frame;

(b) a paddle frame having a rim defining a hollow cavity, a membrane of elastomeric material operatively associated with said rim to provide a taught impact surface within the area defined by said rim, said rim being further modified on one end thereof for articulating engagement to a complimentary modification on a paddle handle; said modification to said paddle handle and to said paddle frame forming, in operative engagement, an articulating joint thereby allowing for hinged movement of the paddle frame relative to the handle in a plane coincident with anticipated use of the paddle in the course of striking of a game piece by the membrane of the paddle frame; and (c) means associated with a paddle handle and the paddle frame at the articulating joint for restraining hinged movement of the paddle frame relative to the handle and restoring the paddle frame to a neutral position relative to the handle.

2. The improvement of claim 1, wherein the means for restraining movement of the paddle frame relative to the handle is external to the paddle frame and the handle.

3. The improvement of claim 1, wherein the means for restraining movement of the paddle frame relative to the handle is internal to the paddle handle.

4. The improvement of claim 1, wherein the paddle frame comprises a rim having a membrane associated therewith which covers the outer surface of the rim thereby defining two striking surfaces and a void therebetween.

* * * * *